US012077359B2

(12) United States Patent
Dluzneski et al.

(10) Patent No.: US 12,077,359 B2
(45) Date of Patent: Sep. 3, 2024

(54) CONTAINERS FOR TRANSPORTING AND STORING LIQUID COMPOSITIONS

(71) Applicant: Arkema Inc., King of Prussia, PA (US)

(72) Inventors: Peter R. Dluzneski, Harleysville, PA (US); Leonard Palys, Downingtown, PA (US); Sara Reynaud, King of Prussia, PA (US)

(73) Assignee: Arkema Inc., King of Prussia, PA (US)

( * ) Notice: Subject to any disclaimer, the term of this patent is extended or adjusted under 35 U.S.C. 154(b) by 628 days.

(21) Appl. No.: 17/272,744

(22) PCT Filed: Oct. 14, 2019

(86) PCT No.: PCT/US2019/056064
§ 371 (c)(1),
(2) Date: Mar. 2, 2021

(87) PCT Pub. No.: WO2020/081430
PCT Pub. Date: Apr. 23, 2020

(65) Prior Publication Data

US 2021/0371181 A1 Dec. 2, 2021

Related U.S. Application Data

(60) Provisional application No. 62/746,043, filed on Oct. 16, 2018.

(51) Int. Cl.

| | |
|---|---|
| ***B65D 77/04*** | (2006.01) |
| ***B65D 77/22*** | (2006.01) |
| ***B65D 88/12*** | (2006.01) |

(52) U.S. Cl.
CPC ..... *B65D 77/0466* (2013.01); *B65D 77/225* (2013.01); *B65D 88/12* (2013.01); *B65D 2588/125* (2013.01)

(58) Field of Classification Search
CPC .. B65D 77/0466; B65D 77/225; B65D 88/12; B65D 2588/125
See application file for complete search history.

(56) References Cited

U.S. PATENT DOCUMENTS

| | | | |
|---|---|---|---|
| 4,857,257 | A | 8/1989 | Chen et al. |
| 5,260,381 | A | 11/1993 | Needham |
| 5,921,420 | A | 7/1999 | Gordon et al. |
| 5,924,589 | A | 7/1999 | Gordon |
| 5,984,126 | A | 11/1999 | Gordon |

(Continued)

FOREIGN PATENT DOCUMENTS

| | | |
|---|---|---|
| CA | 2100044 | 11/1994 |
| CN | 1431129 A | 7/2003 |

(Continued)

*Primary Examiner* — Andrew T Kirsch
(74) *Attorney, Agent, or Firm* — Debodhonyaa Sengupta

(57) ABSTRACT

A container which is useful for safely storing and transporting compositions, such as liquid organic peroxide-containing compositions, which may be flammable, combustible, susceptible to exothermic decomposition, explosive and/or otherwise hazardous, is provided. The container includes a containment vessel having thermoset polymer-containing walls, as well as a vent mechanism. The containment vessel may be manufactured by a rotational molding process using a thermoplastic polymer, such as a polyethylene, which is crosslinked to provide the thermoset polymer.

26 Claims, 2 Drawing Sheets

(56) References Cited

U.S. PATENT DOCUMENTS

| | | | | |
|---|---|---|---|---|
| 6,341,708 | B1 * | 1/2002 | Palley | B65D 88/14 229/122.34 |
| 7,559,431 | B2 | 7/2009 | Schutz | |
| 7,828,995 | B2 | 11/2010 | Kruse et al. | |
| 8,783,503 | B2 | 7/2014 | Waanders et al. | |
| 8,911,842 | B2 | 12/2014 | Spence et al. | |
| 9,738,441 | B2 | 8/2017 | LeBlanc et al. | |
| 2004/0011785 | A1 * | 1/2004 | Van Der Heijden | B65D 1/42 220/4.13 |
| 2004/0164081 | A1 | 8/2004 | Schutz | |
| 2007/0004846 | A1 | 1/2007 | Rogmann et al. | |
| 2008/0161526 | A1 | 7/2008 | Guenther et al. | |
| 2011/0118421 | A1 | 5/2011 | Waanders et al. | |
| 2012/0184685 | A1 | 7/2012 | Korvemaker et al. | |
| 2016/0176582 | A1 * | 6/2016 | McGuire | B65D 35/02 206/277 |
| 2016/0289566 | A1 | 10/2016 | Eric-Carl et al. | |
| 2017/0066394 | A1 | 3/2017 | Nilsson | |
| 2017/0247534 | A1 | 8/2017 | Mariani et al. | |
| 2018/0346220 | A1 | 12/2018 | Weyrauch et al. | |

FOREIGN PATENT DOCUMENTS

| | | | |
|---|---|---|---|
| DE | 9215689 | U1 | 4/1993 |
| DE | 10161693 | A1 | 7/2003 |
| EP | 2 979 991 | A1 | 2/2016 |
| WO | WO 92/21575 | | 12/1992 |

* cited by examiner

CONTAINERS FOR TRANSPORTING AND STORING LIQUID COMPOSITIONS

CROSS-REFERENCE TO RELATED APPLICATIONS

This application is a national stage application under 35 U.S.C. § 371 of PCT/US2019/056064, filed Oct. 14, 2019, which claims benefit to U.S. application Ser. No. 62/746,043, filed Oct. 16, 2018.

FIELD OF THE INVENTION

The present invention relates to containers, in particular composite intermediate bulk containers that are adapted to hold liquid compositions, especially liquid compositions which are flammable or combustible or which comprise compounds such as organic peroxides that are susceptible to exothermic decomposition. The inventive containers exhibit improved safety characteristics as compared to conventional plastic composite intermediate bulk containers, in that they are able to endure fire engulfment for a specified period of time and under specified conditions without breaching. The present invention also provides methods of making such improved containers.

BACKGROUND

Plastic composite intermediate bulk containers have been widely used in industry for many years for the storage and transport of various types of liquid compositions. Intermediate bulk containers (commonly referred to as IBCs), which typically have capacities of about 1000 or 1250 liters, are convenient to use where the quantity of a composition to be stored and/or transported is larger than can be accommodated in a 55 gallon drum but less than that which would fill a rail tank car or tanker truck. Plastic composite IBCs have a containment vessel constructed of a thermoplastic polymer, such as polyethylene, which is placed within a protective cage affixed to or containing a pallet. While thermoplastic polymers having satisfactory chemical and solvent resistance are available, such polymers are susceptible to softening and melting when the plastic composite IBC is exposed to high heat conditions (such as those encountered during a fire). Under such conditions, the plastic containment vessel may lose its structural integrity, causing its contents to be released.

There have been several approaches to provide fire-resistance to plastic composite IBCs mentioned in the patent literature. Several patent documents (DE102015012163A, EP0986421A1, EP2979991A1, KR20170033332A, KR20180056711A, and U.S. Pat. No. 5,921,420) focus on the use of a fire-resistant sheath that is placed completely around the IBC to insulate it from fire. Another approach mentioned in U.S. Pat. Nos. 5,924,589, 5,984,126, US Pat. Pub. No. 2016/0289566 A1, and U.S. Pat. No. 8,289,95 B2 involves incorporating flame retardant additives into the plastic or painting the plastic with an intumescent coating that yields an insulating layer around the IBC in the event of a fire. A third approach mentioned in U.S. Pat. No. 9,738,441B2 utilizes built-in secondary containment to protect the IBC from fire and damage caused by mechanical moving devices such as forklifts.

Containers particularly suitable for the packaging of compounds which are capable of undergoing exothermic decomposition, such as organic peroxides, are also known in the art. For example, U.S. Pat. No. 8,783,503 describes a packaged formulation comprising a compound liable to exothermic decomposition and optionally one or more organic diluents, wherein the formulation is packaged in a container with a volume of at least 250 liters provided with a vent to release gases and made from a thermoplastic material having a Vicat B softening temperature not higher than (a) the run-away temperature of the compound liable to exothermic decomposition if the formulation does not contain any diluent, or (b) the boiling temperature of at least 50 wt % of the total weight of diluent if the formulation does contain organic diluent. However, such packaging is not ideal since the entire contents of the container may be released in the event of a fire of sufficient temperature and duration to melt the thermoplastic material. Another approach is described in U.S. Pat. Publication No. 2012/0184685, which discloses stainless steel IBCs designed to contain liquid peroxide formulations and having a minimum vent area/volume ratio. Such stainless steel IBCs have certain disadvantages, however. They are relatively heavy, which adds to transportation costs and also makes them more difficult to move on-site. Moreover, such stainless steel IBCs are opaque; thus, it is not easy to monitor the level of liquid within them. Also, IBCs of this type are comparatively costly.

U.S. Pat. No. 4,857,257 and US Pat. Pub. No. 2017/0247534 describe the production of crosslinked rotomolded tanks using high density polyethylene (HDPE) homopolymer, linear low density polyethylene (LLDPE), and polyethylene copolymers containing various alpha olefin monomers. U.S. Pat. No. 5,260,381 discloses a similar approach to make a rotomolded crosslinked tank that includes a small amount of ethylene vinyl acetate (EVA) polymer. U.S. Pat. No. 8,911,842 teaches a three layer tank containing an inner barrier layer which is not crosslinked and is encapsulated between two crosslinked layers.

It would be desirable to develop new types of containers that are useful for storing and transporting flammable, combustible or otherwise hazardous liquids and that are capable of meeting more stringent guidelines, such as those described in the 2018 edition of the NFPA (National Fire Protection Association) 30 Code. The present invention is directed to a thermoset Intermediate Bulk Container (IBC) able to endure fire engulfment for 20 minutes without breaching according to the test method described in FM 6020 (Approval Standard for Composite Intermediate Bulk Containers).

SUMMARY OF THE INVENTION

The present invention, according to certain aspects, provides a container useful for storing and transporting a composition (in particular a liquid composition, such as a liquid composition comprised of at least one compound which is at least one of flammable, combustible, explosive, capable of exothermic decomposition or otherwise hazardous), wherein the container is provided with a vent mechanism and comprises a containment vessel comprised of a thermoset polymer.

Other aspects of the invention provide a packaged composition comprising a container and a liquid composition (in particular, a liquid composition comprised of at least one compound which is at least one of flammable, combustible, explosive, capable of exothermic decomposition or otherwise hazardous) packaged within the container, wherein the container is provided with a vent mechanism and comprises a containment vessel comprised of a thermoset polymer.

Also provided by aspects of the present invention is a method of making a container which is provided with a vent mechanism and which comprises a containment vessel comprised of a thermoset polymer, wherein the method comprises a step of forming the containment vessel by rotational molding, blow molding or three dimensional printing.

According to still further aspects of the invention, a method of packaging a liquid composition, (e.g., a liquid composition comprised of at least one compound which is at least one of flammable, combustible, capable of exothermic decomposition, explosive or otherwise hazardous) is provided, wherein the method comprises a step of introducing the composition into a container which is provided with a vent mechanism and which comprises a containment vessel comprised of a thermoset polymer.

DESCRIPTION OF THE DRAWINGS

The invention may be understood from the following description when read in connection with the accompanying drawings.

DETAILED DESCRIPTION OF CERTAIN EMBODIMENTS OF THE INVENTION

Figure 1:
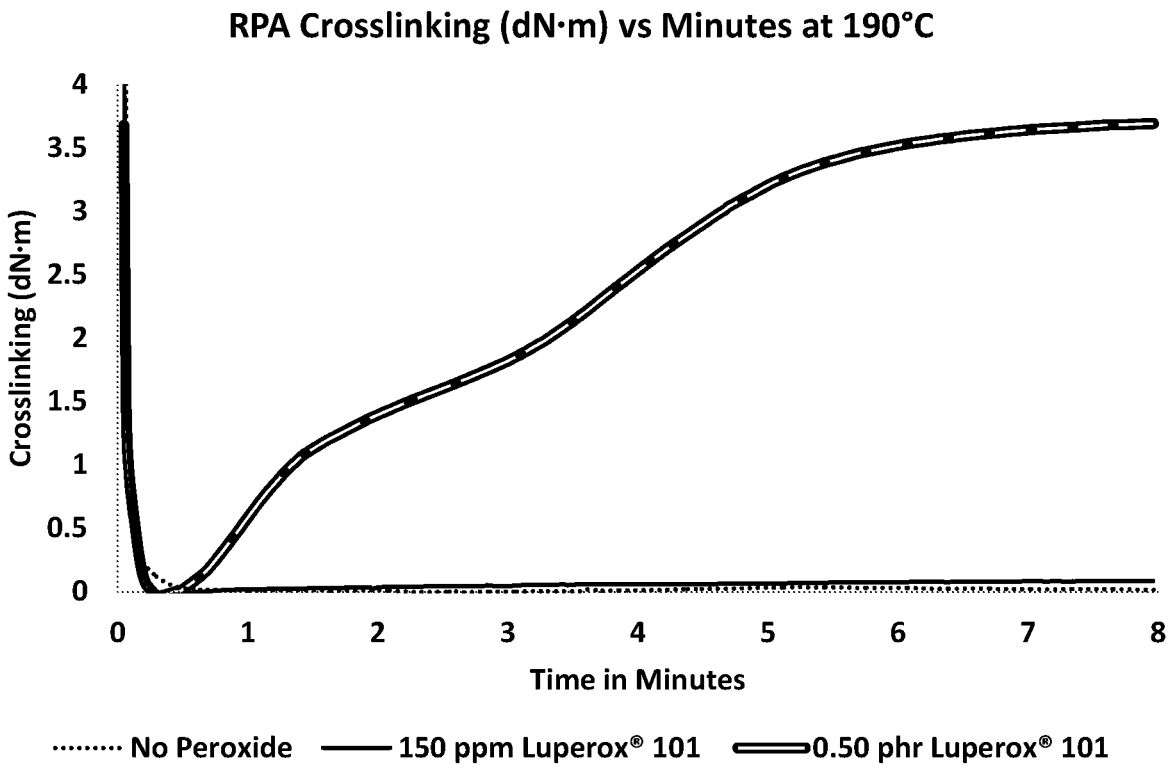
FIG. 1 is a rheograph showing crosslinking versus time for different amounts/loading levels of organic peroxide to crosslink/cure HDPE, including no peroxide.

Containers in accordance with the present invention comprise a containment vessel comprised of a thermoset polymer and additionally have a vent mechanism which permits the release of excessive pressure within the containment vessel, in the event the contents of the containment vessel are exposed to heat and/or undergo decomposition to yield volatile degradation products.

In preferred embodiments of the invention, the container is an intermediate bulk container of 1000 or 1250 liters in capacity which is configured to be capable of enduring fire engulfment for 20 minutes without breaching or leaking according to Test Procedure Class Number 6020, Large Scale Testing for Fire Performance of Intermediate Bulk Containers (FM Approvals LLC, September 2016). This Test Procedure is referenced in the guidelines of National Fire Protection Association Flammable and Combustible Liquids NFPA Code 30 (2018). The large scale fire exposure test involves exposing a 2×2×2 palletized array of eight (8) intermediate bulk containers of 1000 or 1250 liter capacity filled with mineral seal oil to a mineral seal oil pool fire for a duration of 20 minutes. The test array is centered under four sprinklers spaced on a 3.0 by 3.0 m grid. To pass the test, there can be no breach of, or leakage from, the intermediate bulk container during the 20 minute exposure or for 24 hours after the conclusion of the test. Hole formation above the liquid level in the intermediate bulk container is acceptable as long as the net area does not exceed 13 $cm^2$.

To provide a container that is fire-resistant and capable of being able to safely store and transport compositions which are flammable, combustible, explosive or which comprise compounds which undergo exothermic decomposition, the containment vessel which is used as a component of the container is comprised of a thermoset polymer. A thermoset polymer is generally understood to mean a polymer that does not melt when heated, in contrast to a thermoplastic polymer. In the context of the present invention, a thermoset polymer is a polymer that is sufficiently resistant to melting such that when a containment vessel having a capacity of 1000 or 1250 liters having walls containing the polymer is employed in an intermediate bulk container, the resulting intermediate bulk container is capable of enduring fire engulfment for 20 minutes without breaching or leaking according to Test Procedure Class Number 6020, Large Scale Testing for Fire Performance of Intermediate Bulk Containers (FM Approvals LLC, September 2016). According to various embodiments, the walls of the containment vessel are comprised of, consist essentially of or consist of thermoset polymer. That is, the containment vessel has walls containing thermoset polymer, wherein the walls may or may not contain one or more additional materials other than thermoset polymer according to various particular embodiments of the present invention.

A thermoset polymer is a polymer that is resistant to melting and molding, in contrast to a thermoplastic polymer, which is a polymer that will repeatedly soften or melt when heated and harden when cooled. Typically, a thermoset polymer is a substance which has undergone a molecular cross-linking process which is irreversible and which renders the substance infusible. Crosslinking takes place through reaction between polymer chains, leading to the formation of a three-dimensional network structure. According to certain embodiments of the invention, the thermoset polymer of the containment vessel walls is produced by curing of a thermosetting (thermosettable) resin composition, such as an epoxy resin composition, a melamine resin composition, a phenolic resin composition, a thermosettable vinyl ester resin composition, a thermosettable polyester resin composition, or a thermosettable polyurethane or polyurea resin composition. In preferred embodiments of the invention, however, the thermoset polymer is a crosslinked thermoplastic polymer, i.e., a thermoplastic polymer that has been converted into a thermoset polymer through a sufficiently high level of crosslinking of the thermoplastic polymer (the crosslinking density achieved being effective to transform the thermoplastic polymer into a thermoset polymer). In a preferred embodiment, the crosslinked thermoplastic is a crosslinked chlorinated polyethylene known as XL-CPE with a chlorine content range of approximately 34% to 37%.

Prior to crosslinking the thermoplastic polymer (e.g. CPE), various additives known in the art can be added to further increase the flame retardancy of the IBC as needed. Mineral compounds such as aluminum and magnesium hydroxides can be used as flame retardants in this invention. Phosphorus flame retardants, which include phosphate-ester compounds, are non-halogenated compounds that act on the solid state of combustible materials. Other flame retardant plastic additives include brominated flame retardant (BRF) type. These additives can be used alone or in combination to increase flame retardant efficiency. In particular, brominated compounds, chlorinated compounds, brominated polymers or chlorinated polymers are often used in synergy with antimony trioxide. This combination acts as a catalyst to speed the release of bromine and chlorine radicals in gas phase radical quenching.

The use of organic peroxides, in particular the dialkyl class of peroxides, is preferred for producing a containment vessel for an IBC comprised of crosslinked (thermoset) thermoplastic polymer by a rotomolding process. To obtain the minimum necessary amount of crosslinking to render the thermoplastic polymer thermoset in character, the dialkyl peroxide concentration should be (where the thermoplastic polymer is a polyethylene) at least 0.2 phr (parts by weight peroxide per 100 parts by weight of resin). The range of peroxide used can be 0.2 phr to 4.0 phr, preferably 0.25 phr to 3.0 phr, more preferably 0.3 phr to 2.0 phr, still more preferably 0.4 phr to 1.5 phr and even more preferably 0.4 to 1.0 phr. Preferably, a triallyl type coagent (such as triallyl cyanurate, triallyl isocyanurate, triallyl trimellitate, diallyl itaconate, diallyl phthalate, or triallyl phosphate, which may be present in combination) is also used with the peroxide at a level of 0.2 phr to 3.0 phr, preferably 0.3 phr to 2.0 phr, more preferably 0.4 phr to 1.0 phr.

Thus, in accordance with preferred embodiments of the invention, the thermoset polymer is a crosslinked thermoplastic polymer, in particular a thermoplastic resin which has been sufficiently crosslinked to convert the thermoplastic polymer into a thermoset polymer. According to preferred embodiments of the invention, a thermoplastic polymer is first formed into a precursor structure to the containment vessel having substantially the same size and configuration as that of the desired containment vessel, with the thermoplastic polymer in the precursor structure then being crosslinked to provide a thermoset polymer and to obtain a containment vessel suitable for use in the container of the present invention. Suitable forming methods include, for example, blow molding, rotational molding and three-dimensional printing. According to other preferred methods, forming and crosslinking of the thermoplastic polymer take place at the same time or in an overlapping manner (where forming and crosslinking are occurring simultaneously to some extent; for example, during the initial stages of forming the thermoplastic polymer into a containment vessel no crosslinking may take place, with crosslinking then being initiated during the later forming stages).

The degree of crosslinking in a thermoplastic polymer used to construct a containment vessel in accordance with the present invention may be monitored, for example, by subjecting a sample of a crosslinked thermoplastic polymer to a xylene dissolution test in accordance with ASTM D-1998-06 (2006). In this test, a sample which is a cross-section of the crosslinked thermoplastic polymer is first removed from the containment vessel. The sample is then weighed. Next, the sample is boiled in xylene. The sample is then re-weighed and the % weight retention is calculated using the equation: [weight of sample after boiling] divided by [initial weight of the sample] times 100. The higher the % weight retention, the higher the extent of crosslinking. According to various embodiments of the invention, the thermoset polymer utilized in the containment vessel and obtained by crosslinking a thermoplastic polymer has a weight retention, as measured by ASTM D-1998-06 (2006), of at least 60%, at least 70%, at least 80%, at least 90%, at least 95%, at least 99% or even 100%.

There are other methods using instrumentation (i.e., a rheometer) which can be used to determine the relative degree of crosslinking following standardized testing procedures: ASTM D-5289, ASTM D-5992 and ASTM D-6601 rotorless rheometer methods (also known as moving die rheometers or MDR or RPA instruments), which are used for measuring the amount of crosslinking, may be used in the practice of this invention to determine the degree of crosslinking based on the dN·m torque values.

Of particular importance to IBCs made from crosslinked materials for transport of organic peroxides is the relationship of the crosslinked material's elastic modulus G' response versus temperature, particularly at the intersections of the G' at (and above) the critical SADT (self accelerating decomposition temperature). These G' measurements are made using a TA instrument RSA3 Dynamic Mechanical Analyzer (strain controlled) and/or the TA instruments RSA-G2 Solid Analyzer (strain controlled) and/or the Anton Paar MCR502 rheometer (stress controlled) using the procedures and calculations described in ASTM D4065-12 (Standard Practice for Plastics: Dynamic Mechanical Properties: Determination and Report of Procedures). At and above its "SADT" and/or the "run-away" temperature, the organic peroxide will undergo uncontrolled self-accelerated decomposition, generating heat and flammable gases. The relationship of G' and the SADT temperature (the danger temperature) is important when designing a crosslinked containment vessel for an IBC to maintain the integrity of the containment vessel at and above the "SADT" and/or the "run-away" temperature. In summary, it is particularly advantageous that IBC containment vessels made from crosslinked thermoplastic materials be designed to possess a Rubbery Plateau (wherein this region is of effectively constant modulus, G', as a function of temperature above the glass transition temperature, (Tg), at and above the stored material's SADT). Non-crosslinked thermoplastic materials would not exhibit such a feature in their DMA.

According to various embodiments of the invention, the thermoset polymer utilized in the containment vessel and obtained by crosslinking a thermoplastic polymer has a torque value, as measured by ASTM D-5289-95 (Reapproved 2001), using a moving die rheometer and the test conditions of 190° C., 100 cpm and 1° arc, of at least 7 dN·m, at least 8 dN·m, at least 9 dN·m, at least 10 dN·m, at least 15 dN·m, at least 20 dN·m, at least 25 dN·m, at least 30 dN·m, at least 35 dN·m, at least 40 dN·m, at least 45 dN·m or at least 50 dN·m.

The use of a crosslinked thermoplastic polymer as the thermoset polymer used to construct the walls of the containment vessel can provide certain advantages. Many thermoplastic polymers, such as high density polyethylene (HDPE), are nearly opaque. However, once highly crosslinked, such thermoplastic polymers can be rendered much more transparent. This is particularly possible where the crosslinking reaction is performed at a temperature which is sufficiently elevated (e.g., a temperature of about 190° C., where the thermoplastic polymer is HDPE). By using a more highly crosslinked thermoplastic polymer to construct the containment vessel walls, the level of liquid within the containment vessel can be more readily monitored (i.e., the wall transparency enables rapid visual assessment of the liquid level within the container).

A still further advantage is that crosslinking may improve the impact resistance of the containment vessel, as compared to a containment vessel formed of the non-crosslinked thermoplastic polymer. For example, non-crosslinked HDPE can be brittle, especially at the low temperatures typically used and recommended for the storage of certain organic peroxides. A containment vessel made of a non-crosslinked thermoplastic polymer such as an HDPE may be susceptible to cracking when subjected to even relatively minor mechanical impacts during handling, whereby such cracking may compromise the integrity of the containment vessel and result in leakage of its contents. Crosslinking the thermoplastic polymer, such as an HDPE, thus provides a container having improved low temperature impact properties.

Impact properties of the crosslinked thermoplastic materials are measured using a Fractovis (Ceast/Instron) high speed instrumented impact tester. The scope of this high speed impact test is to determine the toughness, load-deflection curves and total energy absorption of the crosslinked thermoplastic material, used to construct a containment vessel for an IBC, from impact events. Since speed can be varied, it can simulate actual impact values at high-speeds (for example, being struck by the metal fork of a fork-lift truck). This sophisticated impact test provides full force energy and energy curves during the milliseconds of the impact using a tup, which is comprised of an impact head and a load cell. The Fractovis impact tester was designed and built to meet the requirements of the plastics industry following the ASTM test method ASTM D3763-15 (High Speed Puncture Properties of Plastics Using Load and Displacement Sensors) as well as other methods including ASTM D5628-96 (Impact Resistance of Flat, Rigid Plastic Specimens by Means of Falling Dart (Tup or Falling Mass).

Yet another potential advantage provided by at least some embodiments of the current invention is that crosslinking may improve the flexibility of the thermoplastic polymer. That is, the walls of a containment vessel comprising a crosslinked thermoplastic polymer may be more flexible than those of an analogous containment vessel comprising the thermoplastic polymer in non-crosslinked form. For example, a polyethylene that has been sufficiently crosslinked may be considered to be an elastomer. Thus, a containment vessel made of such a crosslinked polyethylene may be significantly more collapsible (in the absence of liquid within the containment vessel) as compared to a containment vessel comprising walls of non-crosslinked polyethylene. A more collapsible containment vessel may be advantageous for purposes of storing or disposing of the containment vessel when empty, as well as for more easily monitoring the level of liquid left in the containment vessel as its contents are being dispensed.

Crosslinked polyethylenes are utilized in preferred embodiments of the invention, although other suitable crosslinked thermoplastic polymers include, for example, other types of polyolefins and copolymers of olefins with other types of monomers. The starting thermoplastic polyethylene may be any of the ethylene homopolymers and copolymers known in the art. Suitable ethylene copolymers include copolymers in which ethylene represents at least 60%, at least 70%, at least 80%, or at least 90% by weight of the repeating units in the copolymer, with the balance of the repeating units being one or more comonomers such as olefins, in particular C3-C10 alpha-olefins, and/or vinyl acetate.

Crosslinked high density polyethylene (HDPE) is especially preferred for use where the composition to be packaged in the container is comprised of a flammable and combustible liquid and/or an organic peroxide, since it generally is not degraded by such substances and is chemically compatible with organic peroxides under normal storage conditions (e.g., temperatures of up to about 40° C.).

Also suitable for use are ethylene homopolymers and copolymers which are modified after polymerization, such as by chlorination. Thus, in certain embodiments of the invention, the starting thermoplastic polyethylene includes at least a chlorinated polyethylene. In one embodiment, a blend of at least one chlorinated polyethylene and at least one non-chlorinated polyethylene (such as high density polyethylene) is employed. More generally, blends of two or more different crosslinked thermoplastic polymers could be utilized. For example, two or more thermoplastic polymers could be blended together and the blend then subjected to crosslinking to provide the thermoset polymer.

Crosslinking of the thermoplastic polymer may be accomplished by any suitable means known in the art, provided that the method or methods employed result in a sufficient degree of crosslinking to transform the initially thermoplastic polymer into a thermoset polymer. For example, both chemical crosslinking and physical crosslinking methods may be employed. One such method involves reacting the thermoplastic polymer with one or more organic peroxides, optionally together with one or more coagents. This approach typically results in the formation of carbon-carbon bonds between the polymer chains. Suitable organic peroxides include dialkyl peroxides, alkylaryl peroxides, diacyl peroxides, organic hydroperoxides, peroxyesters, peroxyketals, ketone peroxides and monoperoxycarbonates, for example, 2,5-dimethyl-2,5-di(t-butylperoxy)hexyne-3; p-di-t-butylperoxy(di-isopropyl)benzene; m-di-t-butylperoxy(di-isopropyl)benzene; isopropenyl-t-butyl cumyl peroxide; 1-(2-t-butylperoxyisopropyl)-3-isopropenylbenzene; t-butyl cumyl peroxide; 2,5-dimethyl-2,5-di(t-butylperoxy)hexane; dicumyl peroxide; di-t-butyl peroxide; di-t-amyl peroxide; n-butyl-4,4-bis (t-butyl peroxy) valerate; 1,1-bis (t-butyl peroxy)-3,3,5-trimethylcyclohexane; Trigonox® 301; Trigonox® 311; and combinations thereof. Preferred organic peroxides are those with 1-hour half-life temperatures greater than 99° C. In preferred embodiments of the invention, an amount of organic peroxide is employed which is from 0.5% to 3% by weight of the thermoplastic polymer, in order to attain a relatively high degree of crosslinking. Suitable coagents include, for example, coagents comprising two or more reactive carbon-carbon double bonds (such as those present in allyl, vinyl aromatic and (meth)acrylate functional groups) per molecule such as triallyl cyanurate, triallyl isocyanurate, triallyl trimellitate, diallyl itaconate, diallyl phthalate, triallyl phosphate and combinations thereof. Another suitable coagent is alpha-methylstyrene dimer sold under the brand name of Nofmer® MSD (2,3-diphenyl-4-methyl-1-pentene) which can be used alone or in combination with the allylic functional species described above. According to preferred embodiments of the invention, the amount of coagent used is comparable to the amount of organic peroxide, e.g., 0.5% to 6% by weight of the thermoplastic polymer. Other components which may be present during crosslinking include hydroquinones such as mono-t-butylhydroquinone (MTBHQ) and HQMME (hydroquinone mono methyl ether), peroxide scavengers (to prevent premature crosslinking) such as 4-hydroxy-2,2,6,6-tetramethylpiperidine 1-oxyl (abbreviated 4-OH-TEMPO) and/or antioxidants (including hindered phenols and thio-based antioxidants). Free radical initiators other than organic peroxides can also be utilized to effect crosslinking of a thermoplastic polymer.

Another suitable method comprises moisture curing the thermoplastic polymer, wherein the thermoplastic polymer comprises silane groups capable of crosslinking. Heat and/or a silanol condensation catalyst may be employed to accelerate the rate of crosslinking. Silane-functionalized thermoplastic polymers, including silane-functionalized polyethylenes, are well known in the art. Silane grafting methods may be used to introduce silane functional groups onto a thermoplastic polymer. For example, a vinyl trialkoxysilane (including, for example, vinyl trimethoxysilane and vinyl triethoxysilane) may be grafted onto a polyethylene chain by combining a polyethylene with the vinyl trialkoxysilane and a free radical initiator such as an organic peroxide and initiating reaction of the polyethylene and the vinyl trialkoxysilane, wherein grafting of the silane takes place to form trialkoxy silane functional groups along the polymer chain. In the presence of water, the trialkoxy silane functional groups are converted to silanol functional groups, which may then condense with each other to form crosslinking siloxane bonds.

In a still further method, radiation curing is utilized wherein the thermoplastic polymer is exposed to radiation, such as gamma rays or electron beam radiation. As with peroxide-initiated crosslinking, the covalent crosslinks formed by radiation curing typically are carbon-carbon bonds between the polymer chains.

According to certain embodiments, the walls of the containment vessel may have a single layer of thermoset polymer. In other embodiments, the containment vessel walls may comprise two or more layers of polymer, at least one of which is a thermoset polymer. It is also possible for the containment vessel walls to be comprised of two or more layers of different thermoset polymers. For example, the containment vessel walls may have an outer layer of crosslinked chlorinated polyethylene and an inner layer of crosslinked high density polyethylene. As another example, the outer layer may be crosslinked chlorinated polymer and the inner layer may be a blend of crosslinked high density polyethylene and crosslinked chlorinated polyethylene.

In certain embodiments of the invention, the walls of the containment vessel have at least one layer of at least one thermoset polymer and at least one layer of at least one thermoplastic polymer. For example, a layer of a thermoplastic polymer may be present on the interior of the containment vessel walls with a layer of a thermoset polymer (e.g., a sufficiently crosslinked thermoplastic polymer) may be present on the exterior of the containment vessel walls. In preferred embodiments of the invention, a heat resistant engineering thermoplastic is employed to form such a layer of thermoplastic polymer. Examples of suitable heat resistant engineering thermoplastic polymers include, but are not limited to, fluoropolymers (such as the fluoropolymers sold under the brand name Kynar® by Arkema), polyamides, polyaryl ether ketones (e.g., polyether ketones, polyether ketone ketones, polyether ether ketones, such as the polyaryl ether ketones sold under the brand name Kepstan® by Arkema), polyether sulfones, polycarbonates, aromatic polyesters such as polyethylene terephthalate and polybutylene terephthalate, polysulphones, polyphenylene oxides, polyphenylene sulfines, polyimides, and polyacetals.

If the walls of the containment vessel are comprised of two or more polymeric layers, one or more tie layers may be disposed between adjacent polymeric layers in order to improve or enhance the adhesion between the adjacent polymeric layers. Any of the tie layer compositions known in the art may be used for this purposes; such tie layer compositions are typically polymer-based, but may contain one or more additional additives. The polymer or polymers used in the tie layer composition may preferably be functionalized, for example with reactive and/or polar functional groups such as carboxylic acid groups, carboxylate groups, epoxy groups, hydroxyl groups, anhydride groups and the like. Representative examples of polymers suitable for use in tie layer compositions include, but are not limited to, ethylene-vinyl acetate polymers, ethylene-methyl acrylate polymers, ethylene-butyl acrylate polymers, ethylene-acrylic acid polymers, ethylene-methacrylic acid polymers, polyolefins grafted with maleic anhydride such as ethylene-grafted-maleic anhydride polymers (also known as anhydride-modified polyethylenes), polyamides, fluoropolymers and the like.

While a thermoset polymer (or a blend of different thermoset polymers) may be used by itself to provide the walls of the containment vessel, in certain embodiments the thermoset polymer or polymers are employed in combination with one or more additives. Such additives may be any of the additives known in the polymer art, including for example fillers, flame retardants, fire retardants, antioxidants, light stabilizers (including UV stabilizers and HALS hindered amine light stabilizers), internal and external mold release agents, and combinations thereof. Thus, the containment vessel walls may comprise a thermoset polymer composition comprised of at least one thermoset polymer and at least one additive, such as those previously mentioned. According to a further embodiment of the invention, the containment vessel may comprise thermoset polymer walls which have been externally coated with an intumescent layer or a layer of flame and/or fire retardants which is effective to render the containment vessel more flame and/or fire resistant. However, in other embodiments no such intumescent layer or flame/fire retardant layer is present.

According to certain preferred embodiments of the invention, the thermoset polymer employed to provide the containment vessel walls is non-flammable. In the context of the present invention, "non-flammable" means that the thermoset polymer does not ignite when exposed to an open flame or is self-extinguishing (i.e., the thermoset polymer does not support a flame if ignited). For example, the thermoset polymer may have a UL 94 V rating of V-O. In other embodiments, the thermoset polymer has a Limiting Oxygen Index (LOI), as measured in accordance with ASTM D2863-17a, of at least 30, at least 40, at least 50, or at least 60.

The walls of the containment vessel may be of any desired or suitable thickness; the wall thickness in different portions of the containment vessel may be uniform or variable. For example, the containment vessel may have an average wall thickness of from about 0.5 mm to about 125 mm.

The containment vessel may be of any suitable or desired shape or size. For example, in various embodiments of the invention, the containment vessel may be cubical, cuboid or cylindrical in shape. Where the containment vessel is cubical or cuboid, the containment vessel may have four side walls, a top wall and a bottom wall, each of which is generally planar. Where the containment vessel is cylindrical, the containment vessel may have a single curved side wall, a generally planar top wall and a generally planar bottom wall. The walls may have ridges, pleats or the like to provide rigidity and/or foldability to the containment vessel. The containment vessel defines a containment vessel interior volume. The interior volume of the containment vessel may be, for example, at least 250, at least 500 or at least 750 liters but, independently, not more than 10,000, not more than 5000 or not more than 2500 liters. According to certain embodiments, the containment vessel may have an interior volume of 500 liters to 3000 liters, 900 to 1500 liters or about 1000 liters or about 1250 liters.

The container is equipped with at least one vent mechanism which is configured to permit venting of the contents of the containment vessel. The vent mechanism may be adapted such that it temporarily opens to relieve pressure within the containment vessel and then closes once the internal pressure drops back below a predetermined level. Alternatively, the vent mechanism may be designed such that it remains open once a certain predetermined internal pressure is reached. The vent mechanism or vent mechanisms may be formed integrally with the containment vessel (e.g., molded into or with the containment vessel at the time the containment vessel or precursor structure thereto is being formed) or alternatively may be attached or joined to the containment vessel after the containment vessel is fabricated.

Types of vent mechanisms suitable for use in the present invention include, for example, rupture disks, pressure release valves, pop off caps, rupture bolts, spring-loaded clamp rings, pressure relief portions comprised of a thermoplastic polymer which melts when heated, and pressure relief portions in the containment vessel wall which are sufficiently thin relative to the remainder of the containment vessel wall to accomplish controlled release of pressure within the containment vessel prior to reaching the rupture pressure of the containment vessel when the containment vessel is internally pressurized. The container may be equipped with two or more vent mechanisms, which may be of different types.

The container must have at least one vent mechanism or a plurality of vent mechanisms to quickly release the at least a portion of the contents of the containment vessel in case a certain maximum pressure is exceeded, so that an explosion can be avoided. The required size of this opening (the vent area) depends on, e.g., the volume of the containment vessel, the material of which the containment vessel is made, and the type of liquid composition that is present in the containment vessel. The required minimum vent area for a specific packaged formulation can be determined by the 10 liter venting test as described in Amendment 1 to the 4th revised edition of the Manual of Test and Criteria ST/SG/AC.10/32/Add. 2 (23 Feb. 2005), Appendix 5—of the United Nations Recommendations on the Transport of Dangerous Goods.

The vent area/volume ratio of the container may be at least $20\times10^{-3}$ $m^2/m^3$, preferably at least $50\times10^{-3}$ $m^2/m^3$, more preferably at least $80\times10^{-3}$ $m^2/m^3$, and most preferably at least about $100\times10^{-3}$ $m^2/m^3$. For practical reasons, the vent area/volume ratio preferably is not higher than $250\times10^{-3}$ $m^2/m^3$, more preferably not higher than $125\times10^{-3}$ $m^2/m^3$.

The containment vessel may have one or more openings in its walls, which may or may not be independent of a vent mechanism, which permit substances (e.g., liquids) to be introduced into or withdrawn from the interior of the containment vessel. Desirably, any such openings are configured such that they are capable of being opened and closed, as may be advantageous for filling, draining and/or cleaning the containment vessel.

In one embodiment of the invention, the containment vessel may have an opening which functions as a fill port (for example, on the top wall of the containment vessel) through which a liquid composition can be introduced into the containment vessel in order to fill the containment vessel, using a feed line (such as a hose, pipe or the like) temporarily fluidly connected to the containment vessel. Once the containment vessel has been filled to the desired level, the feed line may be disconnected and the opening (and the containment vessel generally) sealed using a device that comprises a vent mechanism. For example, the opening may be equipped with threads which permit attachment of the feed line as well as a cap comprising a vent mechanism (e.g., the cap comprising a vent mechanism may be screwed onto the threaded opening after disconnecting the feed line). In another embodiment, the opening may be configured such that a dip tube can be introduced through the opening, whereby the dip tube is connected to a pump or the like such that a liquid composition disposed within the containment vessel may be withdrawn from the containment vessel.

The containment vessel may also or alternatively be equipped with a dispensing tap located on the bottom wall of the containment vessel or proximate to the bottom edge of a side wall of the containment vessel, wherein the dispensing tap is configured to permit a liquid composition disposed within the containment vessel to be drained out or otherwise withdrawn from the interior of the containment vessel. The fill port and/or dispensing tap may also be used for the purpose of flushing out and/or cleaning the containment vessel, which may be adapted to be reusable or refillable.

In certain embodiments, the containment vessel may be enclosed within a protective cage. The protective cage may be configured to safeguard the container against being damaged or punctured during use, storage or transport of the container and/or to provide support to the containment vessel (particularly where the containment vessel is otherwise foldable or collapsible). Any of the protective cage designs known in the art can be adapted for use with the containers of the present invention. For example, the protective cage may be a tubular metal cage, such as a tubular reinforced stainless steel or iron cage. The cage may also be constructed with or from a non-metal material, such as a polymeric material or combination of different polymeric materials (e.g., the liquid thermoplastic resins sold by Arkema under the brand name Elium®).

The protective cage may include or may be attached to a pallet. For example, the bottom of the protective cage may be formed into a pallet, wherein the pallet (and thus the container including the containment vessel and its packaged contents) is designed to be moved using a forklift or a pallet jack. The containers of the present invention may be configured to be stackable.

According to certain embodiments of the invention, the container may be configured such that the containment vessel is freestanding (self-supporting). That is, when the containment vessel is empty, it substantially retains its three dimensional shape and is resistant to collapsing or folding. In such embodiments, the walls of the containment vessel may be constructed to be of sufficient thickness that the containment vessel is thereby rendered self-supporting. The base of such a self-supporting containment vessel may be constructed of thermoset polymer and configured to have openings which will accept the prongs of a forklift or other such device, thereby eliminating the need for a separately attached pallet.

The containers of the present invention are especially useful for the packaging of hazardous compositions, especially hazardous liquid compositions. For example, the composition to be packaged may be flammable, combustible, explosive and/or susceptible to exothermic decomposition. Once packaged in the containers of the present invention, such compositions may be readily and conveniently shipped, stored and used with reduced risk of the release of the entire contents of the container or the explosive fragmentation of the container in the event the container is exposed to fire or other high heat situation. Compositions suitable for packaging in accordance with the present invention include compositions that are at least one of flammable, combustible, explosive or capable of exothermic decomposition as well as compositions that comprise at least one compound that is at least one of flammable, combustible, explosive or capable of exothermic decomposition.

Compositions suitable for packaging in the containers of the present invention include, for example, flammable or combustible organic solvents and compositions comprised of at least one flammable or combustible organic solvent and at least one component (other than a flammable or combustible organic solvent) dissolved or dispersed in the at least one flammable or combustible organic solvent. Peroxides, especially organic peroxides, may also be packaged in the containers of the present invention. Such peroxides may be in neat, liquid form or may be dissolved or dispersed in a liquid medium, such as an organic solvent or mixture of organic solvents or in an aqueous emulsion. The organic peroxide or blend of organic peroxides may be formulated with one or more other components besides organic solvents and/or water, such as stabilizers and phlegmatizers. Any type of organic peroxide may be packaged in containers according to the present invention, including for example, diacyl peroxides, peroxyesters, perketals, percarbonates, dialkyl peroxides, alkylaryl peroxides, monoperoxycarbonates, hydroperoxides and the like and combinations thereof.

The containment vessels utilized in the present invention may be fabricated using any suitable method.

For example, in one method for forming the containment vessel, a thermoplastic polymer may be blow molded and then crosslinked to convert the thermoplastic polymer into a thermoset polymer. Methods for blow molding thermoplastic polymers, such as polyethylenes, are well known in the art and may be readily adapted for use in the present invention. Generally speaking, a blow molding process comprises extruding a tube of molten thermoplastic polymer into a mold and then pushing the thermoplastic polymer against the walls of the mold by forcing a compressed gas into the center of the tube. According to one method, a resin composition comprised of a thermoplastic polymer and at least one crosslinking additive (e.g., organic peroxide, allyl-containing coagent and hydroquinone) is blow molded under conditions effective to cause crosslinking of the thermoplastic polymer, during the blow molding and/or by heating the blow-molded precursor structure after blow molding. Crosslinking of the thermoplastic polymer may be achieved by heating the thermoplastic polymer in the presence of an organic peroxide to a temperature effective to activate the organic peroxide (i.e., a temperature effective to generate free radical species from the organic peroxide, which then crosslinks the thermoplastic polymer). Such elevated temperature heating could be carried out while the precursor structure to the containment vessel is still within the mold.

According to another embodiment, a silane-functionalized thermoplastic polymer is used to form a blow-molded precursor structure to the containment vessel (having approximately the same shape and dimensions as the desired containment vessel) which is then converted to the containment vessel by moisture curing the blow-molded precursor structure, wherein the silane-functionalized thermoplastic polymer is crosslinked to form a thermoset polymer.

In a still further embodiment, a thermoplastic polymer is used to form a blow-molded precursor structure, which is subsequently transformed into the containment vessel comprised of thermoset polymer by irradiating and thereby crosslinking the thermoplastic polymer. The irradiation may be carried out using electron beam radiation, gamma radiation or the like.

According to another embodiment, a thermoplastic polymer is formed into a precursor structure to the containment vessel using a three-dimensional printing method. The 3D-printed precursor structure is then converted into a containment vessel having walls comprised of thermoset polymer by any suitable method. For example, the 3D-printed precursor structure may be irradiated using electron beam radiation, gamma radiation or the like, under conditions effective to crosslink the thermoplastic polymer and form a thermoset polymer. Another approach is to use a silane-functionalized thermoplastic polymer to perform the three-dimensional printing of the precursor structure, then moisture-curing the precursor structure to obtain the containment vessel comprised of thermoset polymer. Yet another approach would be to three-dimensionally print a precursor structure to the containment vessel using a crosslinkable thermoplastic resin composition comprised of thermoplastic polymer and free radical initiator (e.g., organic peroxide) and then heat the precursor structure to a temperature and for a time effective to achieve sufficient crosslinking of the thermoplastic polymer to render it thermoset (resistant to melting). Three-dimensional printing techniques employing thermoplastic polymers are well known in the art and any of such techniques can be adapted for use in the present invention, including selective laser sintering and fused filament fabrication.

In a preferred embodiment, the containment vessel may be formed using a rotomolding (rotational molding) method. Any of the rotational molding techniques known in the art may be adapted for use in the present invention. Rotomolding typically involves placing a thermoplastic polymer in particulate form (e.g., in the form of a powder or granules) within a hollow mold, which is then closed and rotated, on two axes, and heated (potentially inside a heated oven) to allow the thermoplastic polymer particles to fuse together, forming a solid, hollow mass on the inside of the mold. The mold is then removed from the oven, to cool by air or water spray. After cooling, the molded hollow part is removed and a new charge of thermoplastic polymer particles is introduced into the interior of the mold to begin another cycle. Illustrative rotational molding methods involving thermoplastic polymers are described, for example, in the following patent documents, each of which is incorporated herein by reference in its entirety for all purposes: U.S. Pat. Nos. 4,857,257; 5,260,381; 8,911,842; and U.S. Pat. No. 2017/0247534, it being understood that such methods must be modified so as to convert the thermoplastic polymer into a thermoset, in accordance with the present invention.

According to one aspect of the present invention, particles of a crosslinkable resin composition comprised of at least one thermoplastic polymer (e.g., at least one polyethylene), at least one free radical initiator (e.g., at least one organic peroxide) and optionally (but preferably) at least one coagent (e.g., at least one compound functionalized with a plurality of vinyl groups) are utilized in a rotomolding process to prepare a containment vessel having walls of thermoset polymer (e.g., crosslinked thermoplastic polymer, such as crosslinked polyethylene). Such particles may, for example, have an average diameter of 50 to 500 microns and may be prepared by any suitable method. For example, a thermoplastic polymer may be compounded with free radical initiator and optionally other components and formed into pellets or granules which are then ground or milled and optionally sieved or otherwise fractionated by size to provide a particulate crosslinkable resin composition. In another embodiment, the thermoplastic polymer (possibly in combination with one or more other additives) may be formed into particles of the desired size and the particles impregnated with a free radical initiator (and possibly other additives, such as a co-agent), in particular a liquid free radical initiator or a solution of a free radical initiator in a suitable solvent or mixture of solvents. Care should be taken during such processing to minimize undesired reaction of the free radical initiator. Where the free radical initiator is activated by heat, for example, the processing temperatures should be maintained below the temperature at which significant conversion of the free radical initiator to free radical species begins to take place. In this way, the thermoplastic (fusible) character of the thermoplastic polymer can be maintained, thus allowing the particles of the crosslinkable resin composition to be satisfactorily rotomolded.

According to certain embodiments of the present invention, particles of a thermoplastic resin composition are introduced into a hollow mold and the hollow mold containing the particles is then rotated while being heated at a temperature effective cause the particles to fuse together to form a precursor structure to the desired containment vessel. The temperature during this molding stage should be maintained below the temperature at which substantial crosslinking of the thermoplastic resin takes place, which would convert the thermoplastic polymer in the unfused particles into a thermoset polymer and interfere with the satisfactory fusing of the particles. However, a relatively low level of crosslinking can be tolerated, since the particles may retain a sufficient degree of thermoplasticity and be fusible even if some crosslinking has taken place. The rotomolded precursor structure can subsequently be converted to the desired containment vessel by heating the precursor structure to a temperature effective to achieve the desired level of crosslinking in the thermoplastic polymer (whereby the thermoplastic polymer in the rotomolded precursor structure is transformed into a thermoset polymer). Such heating can be carried out in the mold (for example, the precursor structure may be retained in the mold and heated to a higher temperature which is effective to activate the free radical initiator (e.g., organic peroxide) and achieve the required degree of crosslinking to convert the thermoplastic polymer into a thermoset), with the rotomolded containment vessel then being removed from the mold. During such further heating, the mold preferably is still rotated to help ensure that the containment vessel retains its desired shape. That is, rotation of the filled mold is continued until at least such time as the walls of the containment vessel attain sufficient thermoset character that the containment vessel does not become distorted if rotation is stopped while the containment vessel is being heated at the free radical initiator activation temperature. In another embodiment, the precursor structure to the containment vessel is removed from the mold and subjected to further heating, under conditions effective to crosslink the thermoplastic polymer to the desired extent, thereby generating a containment vessel having walls of thermoset polymer.

Rotational molding methods may also be used to form containment vessels having multilayer walls, wherein at least one layer is comprised of thermoset polymer. For example, an exterior wall comprised of a thermoset polymer (or precursor to a thermoset polymer, i.e., a crosslinkable thermoplastic polymer composition) may be first formed within a mold using the above-described methods. An interior wall may then be formed by introducing into the interior of the mold particles of a second polymeric composition. The second polymeric composition may be another crosslinkable thermoplastic polymer composition (e.g., a composition comprised of a thermoplastic polymer, a free radical initiator and optionally a coagent) or a noncrosslinkable thermoplastic composition (e.g., a composition comprised of a thermoplastic polymer, but no free radical initiator). Rotomolding of the second polymeric composition particles is then performed, such that a second (interior) layer is formed over the interior surface of the first layer. In another embodiment, the first layer (providing the exterior wall of the containment vessel) is fabricated using particles of a noncrosslinkable thermoplastic polymer composition, while the second layer (providing the interior wall of the containment vessel) is prepared using a crosslinkable thermoplastic polymer composition that is converted to a thermoset polymer.

Once the containment vessel is formed, it may be assembled with one or more further components to provide a container in accordance with the present invention. For example, a containment vessel as described herein may be fitted with a vent mechanism, a fill port, a dispensing tap, a protective cage and/or a pallet. The assembled container can then be charged with a liquid composition, such as a liquid composition comprised of at least one compound that is at least one of flammable, combustible, explosive or susceptible to exothermic decomposition to provide a packaged composition in accordance with the present invention. The packaged composition may be stored and/or transported until the contents of the packaged composition are to be utilized, at which point at least a portion of the composition is withdrawn from the containment vessel (by means of a dispensing tap or dip tube, for example) and then used for the intended purpose. For example, a composition comprised of an organic peroxide may be withdrawn and used to initiate a polymerization or other chemical reaction requiring an organic peroxide.

Various non-limiting aspects of the present invention may be summarized as follows:

Aspect 1: A container useful for storing and transporting a liquid composition (e.g., a liquid composition comprised of at least one compound which is at least one of flammable, combustible, explosive or capable of exothermic decomposition), wherein the container is provided with a vent mechanism and comprises a containment vessel comprised of a thermoset polymer.

Aspect 2: The container of Aspect 1, wherein the thermoset polymer is comprised of at least one crosslinked thermoplastic polymer.

Aspect 3: The container of Aspect 1, wherein the thermoset polymer is comprised of at least one crosslinked polyethylene.

Aspect 4: The container of Aspect 1, wherein the thermoset polymer is comprised of at least one crosslinked polyethylene selected from the group consisting of crosslinked chlorinated polyethylenes; crosslinked low density polyethylenes; crosslinked linear low density polyethylenes; crosslinked high density polyethylenes; compolymers of ethylene with one or more comonomers selected from the group consisting of octene, heptene, hexene, pentene, butene, propene and combinations thereof; and blends thereof.

Aspect 5: The container of any of Aspects 1 to 4 wherein the thermoset polymer has a level of crosslinking effective to render the thermoset polymer resistant to melting, whereby the container is capable of enduring fire engulfment for 5 minutes, 10 minutes, 15 minutes, 20 minutes, 25 minutes or 30 minutes without breaching or leaking according to Test Procedure Class Number 6020, Large Scale Testing for Fire Performance of Intermediate Bulk Containers (FM Approvals LLC, September 2016).

Aspect 6: The container of any of Aspects 1 to 5, wherein the containment vessel has an internal volume of 250 liters to 1500 liters.

Aspect 7: The container of any of Aspects 1 to 6, wherein the containment vessel is sufficiently transparent to permit external detection by the unaided human eye of the level of a liquid composition packaged within the containment vessel.

Aspect 8: The container of any of Aspects 1 to 7, wherein the container is additionally comprised of a protective cage at least partially surrounding the containment vessel and attached to or comprising a pallet.

Aspect 9: The container of any of Aspects 1 to 8, wherein the containment vessel when empty is freestanding, foldable or collapsible.

Aspect 10: The container of any of Aspects 1 to 9, wherein at least part of the vent mechanism is integral with the containment vessel.

Aspect 11: The container of any of Aspects 1 to 10, wherein the vent mechanism comprises a device selected from the group consisting of rupture disks, pressure release valves, pop off caps, rupture bolts, spring-loaded clamp rings, pressure relief portions comprised of a thermoplastic polymer which melts when heated, and pressure relief portions in the containment vessel wall which are sufficiently thin relative to the remainder of the containment vessel wall to accomplish controlled release of pressure within the containment vessel prior to reaching the rupture pressure of the containment vessel when the containment vessel is internally pressurized.

Aspect 12: The container of any of Aspects 1 to 11, wherein the containment vessel is additionally comprised of one or more additives selected from the group consisting of fillers, flame retardants, fire retardants, antioxidants, light stabilizers, internal and external mold release agents, and combinations thereof.

Aspect 13: The container of any of Aspects 1 to 12, wherein the containment vessel has walls which consist of a single layer comprising the thermoset polymer.

Aspect 14: The container of any of Aspects 1 to 12, wherein the containment vessel has walls which comprise a plurality of layers with at least one of the layers comprising the thermoset polymer.

Aspect 15: The container of any of Aspects 1 to 12 or 14, wherein the containment vessel has walls which comprise a first layer comprised of a first thermoset polymer and a second layer comprised of a second thermoset polymer, wherein the first thermoset polymer and the second thermoset polymer are different from each other.

Aspect 16: The container of any of Aspects 1 to 15, wherein the thermoset polymer exhibits a weight retention as measured by ASTM D-1998-06 (2006) of at least 60%.

Aspect 17: The container of any of Aspects 1 to 16, wherein the containment vessel has walls having an average thickness of 0.5 mm to 125 mm.

Aspect 18: The container of any of Aspects 1 to 17, wherein the container additionally comprises at least one of a fill port or a dispensing tap.

Aspect 19: The container of any of Aspects 1 to 18, wherein the thermoset polymer is non-flammable.

Aspect 20: A packaged composition comprising a container in accordance with any of Aspects 1 to 19 and a liquid composition packaged within the container.

Aspect 21: The packaged composition of Aspect 20, wherein the liquid composition is comprised of at least one compound which is at least one of flammable, combustible, explosive or capable of exothermic decomposition Aspect 22: The packaged composition of Aspect 21, wherein the at least one compound includes at least one organic peroxide.

Aspect 23: The packaged composition of Aspect 22, wherein the at least one organic peroxide is present in the composition in neat form, in solution form in combination with one or more solvents, or in aqueous emulsion form.

Aspect 24: A packaged composition comprising a container and a liquid composition, comprised of at least one compound which is at least one of flammable, combustible, explosive or capable of exothermic decomposition, which is packaged within the container, wherein the container is provided with a vent mechanism and at least one of a fill port or a dispensing tap and comprises a containment vessel for the composition having an internal volume of 1000 liters or 1250 liters and having walls comprised of at least one crosslinked polyethylene which has a level of crosslinking effective to render the at least one crosslinked polyethylene resistant to melting, whereby the container is capable of enduring fire engulfment for 20 minutes without breaching or leaking according to Test Procedure Class Number 6020, Large Scale Testing for Fire Performance of Intermediate Bulk Containers (FM Approvals LLC, September 2016).

Aspect 25: A method of making a container in accordance with any of Aspects 1 to 19, comprising a step of forming the containment vessel by rotational molding, blow molding or three-dimensional printing.

Aspect 26: The method of Aspect 25, wherein a thermoplastic polymer is formed into a precursor structure for the containment vessel and the thermoplastic polymer of the precursor structure is thereafter subjected to crosslinking to convert the thermoplastic polymer into the thermoset polymer, thereby providing the containment vessel.

Aspect 27: The method of Aspect 26, wherein crosslinking of the thermoplastic polymer is achieved by a method selected from the group consisting of reacting the thermoplastic polymer with one or more free radical initiators (e.g., organic peroxides), optionally together with one or more coagents; moisture curing the thermoplastic polymer, wherein the thermoplastic polymer comprises silane groups; and radiation curing wherein the thermoplastic polymer is exposed to radiation.

Aspect 28: A method of packaging a liquid composition, comprising a step of introducing the liquid composition into a container in accordance with any of Aspects 1-19.

Within this specification, embodiments have been described in a way which enables a clear and concise specification to be written, but it is intended and will be appreciated that embodiments may be variously combined or separated without departing from the invention. For example, it will be appreciated that all preferred features described herein are applicable to all aspects of the invention described herein.

In some embodiments, the invention herein can be construed as excluding any element or process step that does not materially affect the basic and novel characteristics of the container, methods for making the container, and packaged compositions using the container. Additionally, in some embodiments, the invention can be construed as excluding any element or process step not specified herein.

Although the invention is illustrated and described herein with reference to specific embodiments, the invention is not intended to be limited to the details shown. Rather, various modifications may be made in the details within the scope and range of equivalents of the claims and without departing from the invention.

Experimental Equipment and Procedures Used in the Examples

An Alpha Technologies RPA® 2000E, which is a type of moving die rheometer (also referred to as an "MDR" or a "RPA"), was used to study the crosslinking performance of peroxide formulations in a rotational molding grade of HDPE resin. The RPA provided the determination of the final state of cure MH (dN·m) and the tc90 (min), which is the time needed to attain 90% crosslinking. In these studies, the RPA was set to a 1° arc of strain and a frequency of oscillation of 100 cpm (cycles per minute). The crosslinking temperature was set to 190° C. for both the upper and lower die plattens.

ABBREVIATIONS USED IN THE EXAMPLES

MH=maximum torque in dN·m, which relates to crosslinking.

ML=minimum torque in dN·m (Note: In the examples, the ML value was always zero and hence not listed in the data tables to conserve space).

MH-ML=the relative degree of crosslinking in dN·m.

ts0.4=scorch time in minutes to obtain an increase of 0.4 dN·m in torque starting from the minimum torque ML. This is defined as the time to onset of crosslinking. It measures the amount of time to reach 4% crosslinking where the MH values are approximately 9 to 10 dN·m.

ts1=scorch time in minutes to obtain an increase of 1 dN·m in torque starting from the minimum torque ML. This is another scorch time delay measurement at about 10% crosslinking where the MH values are approximately 9 to 10 dN·m.

tc90=time to 90% of final cure in minutes.

phr=parts by weight of ingredient per hundred parts by weight of resin (i.e., HDPE or polyethylene).

Luperox® 101=2,5-dimethyl-2,5-di(t-butylperoxy) hexane

HDPE=high density polyethylene

CPE=chlorinated polyethylene

EXAMPLES

Example 1

US Pat. Pub. No. 2008/0161526 A1 (published Jul. 3, 2008), entitled "Crosslinked Polyethylene Resin for Large Part Blow Molding," by Guenther et al., teaches, in paragraph [0012], large part blow molding of polyethylene containers, drums and IBC (Industrial Bulk Containers). Guenther states that these articles are crosslinked (by peroxide) polyethylene. However, the following example demonstrates that the polyethylene obtained in accordance with Guenther is not thermoset but thermoplastic. Guenther (paragraph [0019]) uses a maximum of 150 ppm of peroxide and states that too much peroxide may result in undesirable products. Specifically, Luperox® 101 (paragraph [0016]) is used by Guenther at levels of 20 ppm up to only 150 ppm in Table 3.

In the present Example 1, it is shown that using 150 ppm to crosslink HDPE at the 190° C. cure temperature taught by Guenther is much too low of a peroxide concentration to develop a crosslinked HDPE polymer that is thermoset, rather than thermoplastic.

The significance of the data presented in Table 1 below is that, regardless of Guenther's claim of obtaining "crosslinked" polyethylene, Guenther requires a thermoplastic HDPE polymer for the blow molding process wherein the final polyethylene must be very similar in performance to the virgin HDPE polymer, prior to reaction with peroxide. The RPA rheometer data in the present example prove that after reacting with 150 ppm of Luperox® 101 the resulting polyethylene performs the same as, and exhibits identical rheology to, the virgin (no peroxide) HDPE. The "crosslinked" polyethylene of Guenther thus would not be sufficiently resistant to melting to be useful in fabricating a containment vessel which, when part of an intermediate bulk container having a capacity of 1000 or 1250 liters, is capable of enduring fire engulfment for 20 minutes without breaching or leaking according to Test Procedure Class Number 6020, Large Scale Testing for Fire Performance of Intermediate Bulk Containers (FM Approvals LLC, September 2016).

The MH maximum torque in dNm is 0 dN·m after modifying the HDPE with 150 ppm of Luperox® 101. The no peroxide HDPE also provided a MH maximum torque of 0 dN·m.

In comparison, 0.5 phr (5000 ppm) of Luperox® 101 crosslinked the HDPE, as it provided a MH maximum torque and a MH-ML (relative degree of crosslinking) of 3.70 dN·m (the minimum torque obtained was 0 dN·m). As higher amounts of Luperox® 101 were used, the relative degree of crosslinking (MH-ML) increased as shown in Table 1.

Figure 2:
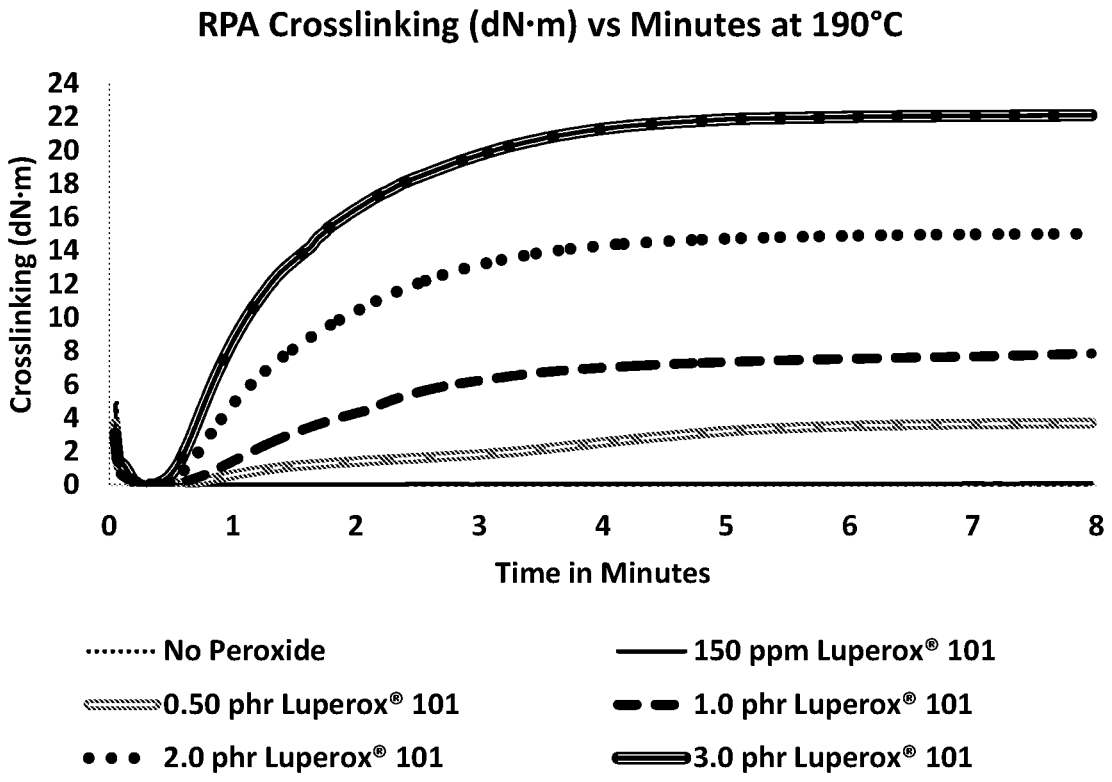
FIG. 2 is a rheograph showing crosslinking versus time for different amounts/loading levels of organic peroxide to crosslink/cure HDPE, including no peroxide.

In summary, after reacting HDPE with 150 ppm Luperox® 101 in accordance with the procedures described by Guenther, the final HDPE polymer is not substantially different from the virgin HDPE (no peroxide used), such that the polyethylene used by Guenther to blow mold an IBC container was thermoplastic and not truly crosslinked (thermoset). See Table 1 below and the rheographs shown in FIG. 1 and FIG. 2. A containment vessel made from such a polyethylene therefore should melt and should not survive fire engulfment.

TABLE 1

RPA ® 2000 Alpha Technologies Rheometer; 190° C., 100 cpm and 1° arc Reacting HDPE with Luperox ® 101 organic peroxide

| Run # | | 1 | 2 | 3 | 4 | 5 | 6 |
|---|---|---|---|---|---|---|---|
| Polyethylene type | | HDPE | HDPE | HDPE | HDPE | HDPE | HDPE |
| Curative | | No Peroxide | 150 ppm Luperox ® 101 | 0.50 phr Luperox ® 101 | 1.0 phr Luperox ® 101 | 2.0 phr Luperox ® 101 | 3.0 phr Luperox ® 101 |
| MH | dN · m | 0.00 | 0.00 | 3.70 | 7.87 | 15.02 | 22.10 |
| ML | dN · m | 0.00 | 0.00 | 0.00 | 0.00 | 0.00 | 0.00 |
| MH − ML | dN · m | 0.00 | 0.00 | 3.70 | 7.87 | 15.02 | 22.10 |
| ts1 | min. | 0.00 | 0.00 | 1.28 | 0.91 | 0.6 | 0.53 |
| tc90 | min. | 0.00 | 0.00 | 5.25 | 4.16 | 3.21 | 3.07 |

Example 2

In this example, HDPE and a blend of HDPE and CPE (having a 36% Chlorine content) were cured. The peroxide formulation used was "Curative E-2", the composition of which is provided in Table 2. The curative level was varied from 1.0 phr to 1.5 phr and the relative amount of crosslinking, as determined by the MH-ML values in dN·m obtained using a RPA rheometer, when crosslinking either the HDPE or the HDPE and CPE blends at 190° C. for eight minutes was measured using a 1° arc strain and a frequency of 100 cpm (cycles per minute).

TABLE 2

| "Curative E-2" | |
|---|---|
| Parts by wt. | Component |
| 60.0 | triallyl cyanurate |
| 36.0 | m/p-di(t-butylperoxy)diisopropylbenzene |
| 2.5 | mono-tert-butyl hydroquinone |
| 1.5 | 1-(2-t-butylperoxyisopropyl)-3-isopropenylbenzene |

TABLE 3

| Crosslinking of HDPE and HDPE/CPE Blends | | | | | | |
|---|---|---|---|---|---|---|
| HDPE (parts) | 100.00 | 100.00 | 100.00 | 90.00 | 90.00 | 90.00 |
| 36% C1 CPE (parts) | 0.00 | 0.00 | 0.00 | 10.00 | 10.00 | 10.00 |
| Curative-E2 (phr) | 1.00 | 1.25 | 1.50 | 1.00 | 1.25 | 1.50 |
| RPA Rheometer; 8 minute cure at 190° C., 100 cpm, 1° arc | | | | | | |
| MH (dN · m) | 8.72 | 10.98 | 13.60 | 7.44 | 10.74 | 12.70 |
| ML(dN · m) | 0.00 | 0.00 | 0.01 | 0.02 | 0.01 | 0.01 |
| MH − ML (dN · m) | 8.72 | 10.98 | 13.59 | 7.42 | 10.73 | 12.69 |

This example demonstrates that it is possible to crosslink a blend of HDPE and CPE for a rotational molding application to create a containment vessel for an IBC wherein as the Curative E-2 concentration is increased a higher degree of crosslinking is obtained based on the MH-ML values measured in dN·m (deci-Newton·meters). A minimum of 7 dN·m relative degree of crosslinking is desired when creating a containment vessel for an IBC by a rotational molding operation which was obtained using 1.0 phr of the curative composition of Table 2. Preferably, at least 1.25 phr of the "Curative E-2" is used and more preferably 1.5 phr of the "Curative E-2" is used to obtain a thermoset polymer useful for fabricating a containment vessel for an IBC in accordance with the present invention.

Example 3

In this Example 3 we studied the flammability of HDPE, crosslinked HDPE, CPE and crosslinked CPE. No flame retardants chemicals or antioxidants or fillers were added to these polymers. Only virgin polymer forms were tested in this example to study the effect of crosslinking on the ability of a polymer to help withstand being set on fire.

The original forms of the HDPE and CPE polymers were a fine powder. Five inches long by half-inch wide by one-eighth inch thick testing bars were molded from each powder. The powder HDPE used had a reported density range of 0.94 to 0.97 g/cm3. The powder CPE polymer had a reported 36% Chlorine content.

A molding temperature of 185° C. was used for producing the HDPE (non crosslinked high density polyethylene) and the XL-HDPE (crosslinked HDPE) test bars. A 195° C. molding temperature was used for producing the CPE (non crosslinked chlorinated polyethylene) and the XL-CPE (crosslinked chlorinated polyethylene) test bars. In each case the molding operation was conducted using a Carver press using 15,000 psi pressure for 20 minutes for molding all the HDPE, crosslinked HDPE, CPE and crosslinked CPE test bars. Five test bars were made.

When producing the crosslinked HDPE and CPE bars, prior to using the molding operation described above, a quantity of 4 phr (parts peroxide formulation per 100 parts of polymer resin) was carefully added to the polymeric powder. This was done using a small bullet high speed blender, mixing for several minutes, to uniformly blend the molten peroxide formulation with the powdered HDPE and CPE. The peroxide formulation used was "Curative E-3", the composition of which is provided in Table 4. This peroxide composition was partially liquid at room temperature, so it was completely molten by placing the container in a hot air oven set to 60° C. for about an hour and completely molten prior to addition to the powdered polymers.

TABLE 4

| "Curative E-3" | |
|---|---|
| Parts by wt. | Component |
| 60.0 | triallyl cyanurate |
| 36.0 | m/p-di(t-butylperoxy)diisopropylbenzene |
| 2.5 | mono-tert-butyl hydroquinone |
| 1.5 | 1-(2-t-butylperoxyisopropyl)-3-isopropenylbenzene |

TABLE 5

| Polymer Powder Formulations used to make the test bars | | | | |
|---|---|---|---|---|
| Sample test bars: | A | B | C | D |
| HDPE (grams) | 100 | 100 | 0 | 0 |
| CPE (grams) | 0 | 0 | 100 | 100 |
| Curative E-3 (grams) | 0 | 4 | 0 | 4 |

Sample bars using the polymer powder formulations in Table 5 were molded using a carver press using conditions described earlier in this example. These bars were used in a gas flame burn test described here. The polymer test bars (A to D) were clamped in a vertical position and the lower portion of the bar was engulfed/exposed to a gas flame until it the bar begins to ignite at which point the gas flame is removed and observations were made and recorded.

TABLE 6

| Sample Bar Gas Flame Testing Results | |
|---|---|
| Test Bar Description | Sample Bar Gas Flame Testing Results |
| HDPE (bar A Table 5) | Bar ignited and after 3 seconds began to drip; no self-extinguish |
| XL-HDPE (bar B Table 5) | Bar ignited and after 11 seconds began to drip; no self-extinguish |
| CPE (bar C Table 5) | Bar ignited and after 33 seconds self-extinguished |
| XL-CPE (bar D Table 5) | Bar ignited and after 3 seconds self-extinguished |

This example illustrates the importance of using a crosslinked polymer and how such a crosslinked polymer can combat a fire engulfment. None of these polymers had any additional fire retardant ingredients. When designing a polymer formulation to mold or produce an IBC container the use of fire retardant additives would be preferred/desired and would be added to a CPE which would then be crosslinked to form a XL-CPE containing fire-retardants.

The purpose of this example is to illustrate the value of organic peroxide formulations to crosslink select polymers to offer an additional layer of defense in a fire engulfment. No addition of fire retardants was made to the polymers used in this example. The XL-CPE (crosslinked CPE) with no addition of a fire retardant self-extinguished in only 3 seconds versus 33 seconds for the non crosslinked CPE with no addition of a fire retardant, as per Table 6 "Sample Bar Gas Flame Testing Results".

What is claimed is:

1. A container configured to store and/or transport a liquid composition comprising at least one organic peroxide, wherein the container is provided with a vent mechanism and comprises a containment vessel having walls comprised of a thermoset polymer, said thermoset polymer comprising at least one crosslinked thermoplastic polymer;

wherein the thermoset polymer has a level of crosslinking effective to render the thermoset polymer resistant to melting, whereby the container is capable of enduring fire engulfment for 20 minutes without breaching or leaking according to Test Procedure Class Number 6020, Large Scale Testing for Fire Performance of Intermediate Bulk Containers (FM Approvals LLC, September 2016).

2. The container of claim 1, wherein the thermoset polymer is comprised of at least one crosslinked polyethylene.

3. The container of claim 1, wherein the thermoset polymer is comprised of at least one crosslinked polyethylene selected from the group consisting of crosslinked chlorinated polyethylenes; crosslinked low density polyethylenes; crosslinked linear low density polyethylenes; crosslinked high density polyethylenes; copolymers of ethylene with one or more comonomers selected from the group consisting of octene, heptene, hexene, pentene, butene, propene and combinations thereof; and blends thereof.

4. The container of claim 1, wherein the containment vessel has an internal volume of 250 liters to 1500 liters.

5. The container of claim 1, wherein the containment vessel is sufficiently transparent to permit external detection by the unaided human eye of the level of a liquid composition packaged within the containment vessel.

6. The container of claim 1, wherein the container is additionally comprised of a protective cage at least partially surrounding the containment vessel and attached to or comprising a pallet.

7. The container of claim 1, wherein the containment vessel when empty is freestanding, foldable or collapsible.

8. The container of claim 1, wherein at least part of the vent mechanism is integral with the containment vessel.

9. The container of claim 1, wherein the vent mechanism comprises a device selected from the group consisting of rupture disks, pressure release valves, pop off caps, rupture bolts, spring-loaded clamp rings, pressure relief portions comprised of a thermoplastic polymer which melts when heated, and pressure relief portions in the containment vessel wall which are sufficiently thin relative to the remainder of the containment vessel wall to accomplish controlled release of pressure within the containment vessel prior to reaching the rupture pressure of the containment vessel when the containment vessel is internally pressurized.

10. The container of claim 1, wherein the containment vessel is additionally comprised of one or more additives selected from the group consisting of fillers, flame retardants, fire retardants, antioxidants, light stabilizers, internal and external mold release agents and combinations thereof.

11. The container of claim 1, wherein the containment vessel has walls which consist of a single layer comprising the thermoset polymer.

12. The container of claim 1, wherein the containment vessel has walls which comprise a plurality of layers with at least one of the layers comprising the thermoset polymer.

13. The container of claim 1, wherein the containment vessel has walls which comprise a first layer comprised of a first thermoset polymer and a second layer comprised of a second thermoset polymer, wherein the first thermoset polymer and the second thermoset polymer are different from each other.

14. The container of claim 1, wherein the thermoset polymer exhibits a weight retention as measured by ASTM D-1998-06 (2006) of at least 60%.

15. The container of claim 1, wherein the containment vessel has walls having an average thickness of 0.5 mm to 125 mm.

16. The container of claim 1, wherein the container additionally comprises at least one of a fill port or a dispensing tap.

17. The container of claim 1, wherein the thermoset polymer is non-flammable.

18. A packaged composition comprising a container in accordance with claim 1 and a liquid composition which is packaged within the container.

19. The packaged composition of claim 1, wherein the at least one organic peroxide is present in the composition in neat form, in solution form in combination with one or more solvents, or in aqueous emulsion form.

20. A packaged composition comprising a container and a liquid composition, said liquid composition comprised of at least one organic peroxide, which is packaged within the container, wherein the container is provided with a vent mechanism and at least one of a fill port or a dispensing tap which is independent of the vent mechanism and comprises a containment vessel for the composition having an internal volume of 1000 liters or 1250 liters having walls comprised of at least one crosslinked polyethylene which has a level of crosslinking effective to render the at least one crosslinked polyethylene resistant to melting, whereby the container is capable of enduring fire engulfment for 20 minutes without breaching or leaking according to Test Procedure Class Number 6020, Large Scale Testing for Fire Performance of Intermediate Bulk Containers (FM Approvals LLC, September 2016).

21. A method of making a container in accordance with claim 1, comprising a step of forming the containment vessel by rotational molding, blow molding or three-dimensional printing.

22. The method of claim 21, wherein a thermoplastic polymer is formed into a precursor structure for the containment vessel and the thermoplastic polymer of the precursor structure is thereafter subjected to crosslinking to convert the thermoplastic polymer into the thermoset polymer, thereby providing the containment vessel.

23. The method of claim 22, wherein crosslinking of the thermoplastic polymer is achieved by a method selected from the group consisting of reacting the thermoplastic polymer with one or more free radical initiators, optionally together with one or more coagents; moisture curing the thermoplastic polymer, wherein the thermoplastic polymer comprises silane groups; and radiation curing wherein the thermoplastic polymer is exposed to radiation.

24. A method of packaging a liquid composition, comprising a step of introducing the composition into a container in accordance with claim 1.

25. The container of claim 1 wherein the thermoset polymer is comprised of crosslinked chlorinated polyethylene, optionally with a chlorine content range of about 34% to 37%.

26. The container of claim 1 wherein the thermoset polymer has a torque value, as measured by ASTM D-5289-95 (Reapproved 2001), of at least 7 dN.m.

* * * * *